US006329025B1

(12) United States Patent
Bacon et al.

(10) Patent No.: US 6,329,025 B1
(45) Date of Patent: Dec. 11, 2001

(54) METHOD AND APPARATUS FOR ELECTROMAGNETIC POWDER DEPOSITION

(75) Inventors: James L. Bacon; Darwin G. Davis; Robert L. Sledge, all of Austin; Robert J. Polizzi, Del Valle; John R. Uglum, Jr., Austin, all of TX (US); William F. Weldon, Gerrard's Cross (GB); Raymond C. Zowarka, Austin, TX (US)

(73) Assignee: University of Texas System Board of Regents, Austin, TX (US)

( * ) Notice: Subject to any disclaimer, the term of this patent is extended or adjusted under 35 U.S.C. 154(b) by 0 days.

(21) Appl. No.: 09/095,197

(22) Filed: Jun. 10, 1998

Related U.S. Application Data

(60) Provisional application No. 60/050,392, filed on Jun. 20, 1997.

(51) Int. Cl.[7] ..... B06D 1/00

(52) U.S. Cl. ..... 427/598; 427/180; 427/190; 427/191; 427/205

(58) Field of Search ..... 427/180, 189, 427/190, 191, 446, 453, 459, 455, 576, 195, 202, 598, 205; 239/79, 85; 118/306, 623

(56) References Cited

U.S. PATENT DOCUMENTS 3,100,724 * 8/1963 Rocheville .
5,302,414 * 4/1994 Alkhimov et al. .

FOREIGN PATENT DOCUMENTS 6-272044A * 9/1994 (JP) .

OTHER PUBLICATIONS

Bacon et al., "A new electromagnetic powder deposition system," United Thermal Spray Conference, Indianapolis, Indiana, Sep. 15–17, 1997.

Bacon et al., "The diagnostic history of a new electromagnetic powder deposition system," United Thermal Spray Conference, Indianapolis, Indiana, Sep. 15–17, 1997.

Sledge et al., "Arc initiation for the electromagnetic powder deposition gun," United Thermal Spray Conference, Indianapolis, Indiana, Sep. 15–17, 1997.

Uglum et al., "Scaling analysis of the electromagnetic powder deposition gun," United Thermal Spray Conference, Indianapolis, Indiana, Sep. 15–17, 1997.

"Thermal–Spraying Device with Rail Gun Utilized Therefor", abstract of JP 403127658A, May 30, 1991.

Patent Cooperation Treaty International Search Report for application PCT/US98/12896, Oct. 13, 1998.

* cited by examiner

*Primary Examiner*—Fred J. Parker
(74) *Attorney, Agent, or Firm*—Fulbright & Jaworski L.L.P.

(57) ABSTRACT

The present invention provides a method for depositing powder particles on a substrate. The method comprises forming a planar plasma armature, accelerating the plasma armature, accelerating a column of gas with the plasma armature; and accelerating the powder particles with the column of gas. The present invention provides for a railgun, comprising first and second conducting rails, and first and second insulating rails. The insulating and conducting rails form a bore of the railgun. The first and second conducting rails are separated by the insulating rails. At least one of the rails has a port in the wall thereof, the port is adapted to introducing powder particles into the bore.

24 Claims, 15 Drawing Sheets

METHOD AND APPARATUS FOR ELECTROMAGNETIC POWDER DEPOSITION

This application claims the benefit of U.S. Provisional Application No. 60/050,392 filed on Jun. 20, 1997.

BACKGROUND OF THE INVENTION

1. Field of the Invention

This invention relates generally to methods and apparatus for depositing plating materials on a substrate, and more particularly, to a method and apparatus for employing a railgun to perform plating and/or material build up.

2. Description of the Related Art

Electrolytic plating is a process of building up layers of material on the surface of a substrate. The electrolytic plating process has some limitations. For example, electrolytic plating is inconvenient when employed for large objects, it has a limited ability to form layers having an inhomogeneous thickness, and some materials are difficult to use because of the chemical properties of the materials. The prior art has developed thermal spray and explosive techniques for depositing material on a substrate, in part, to avoid the above-mentioned problems.

The thermal spray techniques employ the thermal expansion of a gas to power the deposition of the plating material. Examples of thermal spray techniques include flame, high velocity oxygen fueled (HVOF), detonation-gun (D-Gun), and plasma spraying. Thermal spray techniques can impart velocities to the plating material not exceeding the velocity of the expanding gases that power the underlying thermal process. Thermal velocities of gases are limited to about 1 kilometer (km) per second. Since plating particles having velocities of 1 km per second ordinarily have kinetic energies lower than the heat of fusion of the particles, thermal spray techniques do not ordinarily melt plating particles upon impact with the substrate. Thermal spray techniques do not ordinarily enable forming the strong bond between the plating material and the substrate that would result if the plating particles melted upon impact.

The prior art has employed explosive deposition processes in situations where it is desirable to directly deposit initially solid plating materials. To use explosive processes, the plating material is formed into a shell. For example, the plating material may be a shell of aluminum foil. Then, an explosion, e.g., an oxyacetylene explosion, catpults the shell of plating material towards the substrate to be plated.

Explosive deposition techniques also have limitations. First, the deposited plating layer ordinarily contains both the plating material and the shell matrix, because both the shell and the plating material are catapulted towards the substrate by the explosion. To eliminate plating impurities, the shell matrix can be fabricated with the plating material itself. But, expensive plating materials lead to prohibitive costs when used to construct the shell matrix. Second, explosive techniques are not amenable to the high repetition rates that are necessary to deposit thick plating layers in a controlled fashion. The explosive technique does not offer a versatile method for building up layers of material on a substrate. Third, explosive techniques do not accelerate the plating materials to velocities greater than velocities of the order of the speed of sound. Fourth, the technique is not amenable to complex geometric surfaces. Fifth explosive/thermal spray techniques tend to produce plating deposits with a substantial number of voids. The voids can result in the development of cracks in plating layers that are thicker than about 0.030 inches.

The present invention is directed to overcoming, or at least reducing, the effects of one or more of the problems set forth above.

SUMMARY OF THE INVENTION

In one aspect the present invention provides for a method for depositing powder particles on a substrate. The method comprises forming a plasma armature, accelerating the plasma armature, accelerating a column of gas with the plasma armature; and accelerating the powder particles with the column of gas. In another aspect the present invention provides for a railgun, comprising first and second conducting rails and first and second insulating rails. The insulating and conducting rails form a bore of the railgun. The first and second conducting rails are separated by the insulating rails. At least one of the rails has a port in the wall thereof, the port is adapted to introducing powder particles into the bore.

BRIEF DESCRIPTION OF THE DRAWINGS

Other objects and advantages of the invention will become apparent upon reading the following detailed description and upon reference to the drawings in which.

Figure 1:
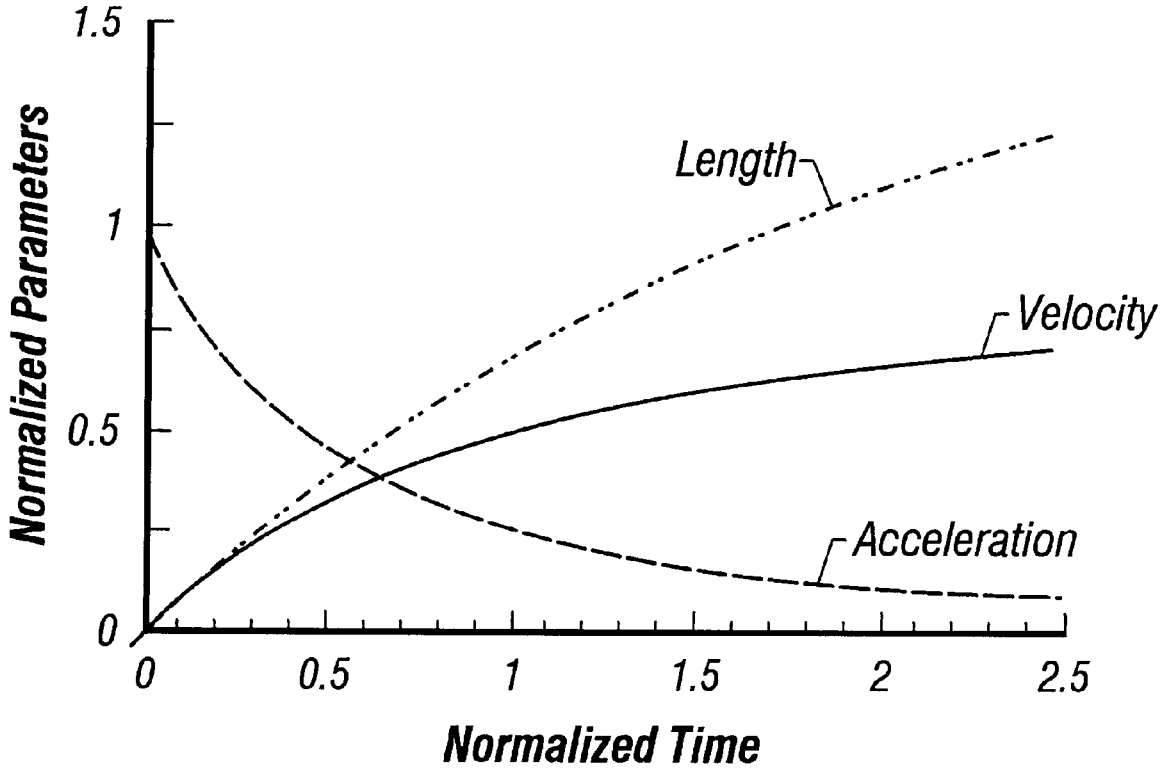
FIG. 1 shows the dimensionless velocity "f" and acceleration "a" of a powder particle, subjected to drag forces, as a function of dimensionless time variable "ξ"

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

1. Gas-dynamic Particle Acceleration

The specific embodiments employ gas-dynamic generated viscous drag as a means of accelerating powder particles to supersonic velocities. The operating parameters of the illustrative embodiments can, to a first approximation, be obtained from the dynamics of a single powder particle as long as the density of the powder particles is not so high that multi-particle effects significantly effect the dynamics. The gas-dynamics can be approximated as one dimensional.

For an approximately spherical powder particle of diameter $D_P$ and density $\rho_P$ and a streaming gas column having density $\rho_G$ and velocity $V_G$, the dynamics of the powder particle are determined from the Newtonian dynamical equation:

$$M_P \frac{dV_P}{dt} = C_D A_P P_K. \tag{1}$$

$M_P$, $A_P$, $V_P$, $\rho_P$ and $D_P$ are the particle's mass, cross-sectional area, velocity, density, and diameter, respectively. $C_D$ is the drag coefficient, which is empirically known to be close to unity for supersonic flows having a wide range of Mach numbers$\geqq$1. $P_K$ is the gas kinetic pressure, i.e. $P_K=\rho_G(V_G-V_P)^2/2$.

The particle's dynamics can also be described with dimensionless variables:

$$f = \frac{V_P}{V_G}, \xi = \frac{t}{\tau},$$

and $$\tau = \frac{4}{3}\frac{1}{C_D}\frac{\rho_P}{\rho_G}\frac{D_P}{V_G}.$$

In terms of the dimensionless variables, equation (1) can be rewritten in the form:

$$\frac{df}{d\xi} = (1-f)^2. \tag{2}$$

For the initial condition $V_P(0)=0$, the solution for the dimensionless velocity is:

$$f = \frac{\xi}{1+\xi}. \tag{3}$$

Equation (3) can be differentiated with respect to $\xi$ to obtain a dimensionless acceleration "a":

$$a = \frac{df}{d\xi} = \frac{1}{(1+\xi)^2}. \tag{4}$$

The solutions (3) and (4) to the dimensionless dynamical equation (2) can be used to estimate operating parameters of the illustrative embodiments for electromagnetic powder deposition (EPD).

FIG. 1 shows the dimensionless velocity "f" and the dimensionless acceleration "a" as a function of the dimensionless time variable $\xi$. During the dimensionless time interval $\xi \in [0,1]$, the particles are accelerated to about one-half of the velocity of the gas $V_G$, and the acceleration falls to about one quarter of the initial value and is rapidly decreasing with time. Thus, only small increases in the velocity f are obtained by accelerating the powder particle longer than the interval [0,1] in the variable $\xi$.

The embodiments illustrated below accelerate powder particles during one normalized time interval, i.e. during the interval defined by $\xi \in [0,1]$. An ordinary person in the art can use the above-described analysis to determine the operating parameters of embodiments that accelerate powder particles during longer or shorter time intervals without the need to perform undue experimentation. The invention is intended to also cover other embodiments where the powder particles are accelerated during longer and shorter time intervals.

Accelerating powder particles, having $C_D$~1, for one normalized time interval can result in supersonic velocities. This requires accelerating the particles for a real time $\delta t$ approximately given by:

$$\delta t = \frac{4}{3}\frac{\rho_P}{\rho_G}\frac{D_P}{V_G} \tag{5}$$

A gas column of length $L_G$ will accelerate the powder particles only if the gas is moving faster than the particle velocity $V_P$. From the above equation for the time period $\delta t$, one can estimate the length $L_G$ of the gas column needed.

$$L_G = \int (V_G - V_P)dt = \tau V_G \int \frac{d\xi}{1+\xi} = 0.9242\frac{\rho_P}{\rho_G}D_P \tag{6}$$

From equation (6), the $L_G$ needed to accelerate the particles to about half the velocity of the gas scales approximately linearly with particle density and size and scales approximately inversely with the gas density.

2. Railgun

Figure 2:
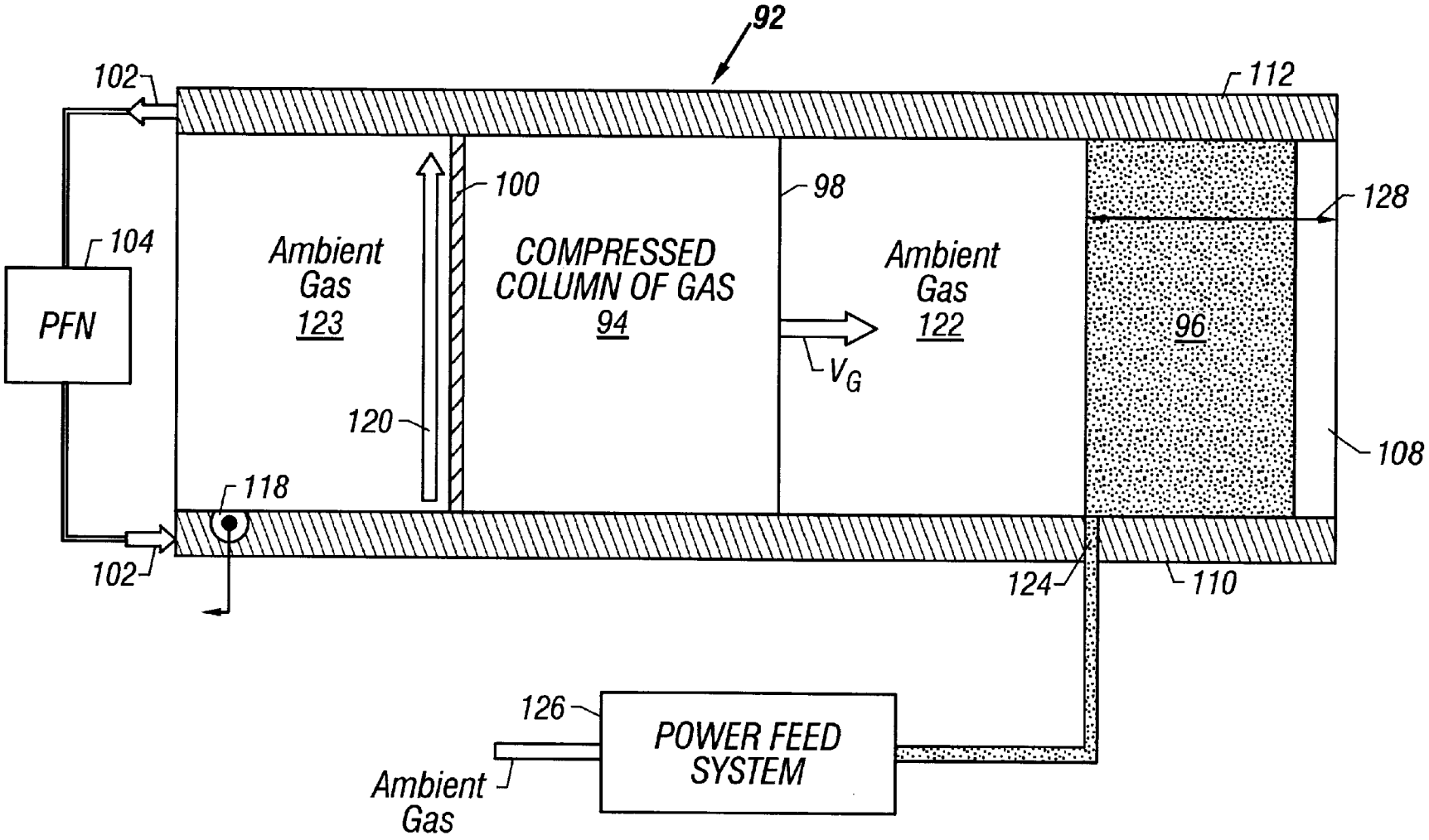
FIG. 2 illustrates one embodiment of a railgun for performing electromagnetic powder deposition.

FIG. 2 illustrates one embodiment for a railgun 92 for electromagnetic powder deposition operating in single discharge or in multiple discharge modes. The railgun 92 employs a high velocity compressed column of gas 94 to accelerate particles of a powder cloud 96. The compressed column of gas 94 has a shock front 98 and is moved down the railgun 92 by a plasma armature 100. The plasma armature 100 is in turn accelerated by magnetic fields produced by a current pulse 102 circulating in the railgun 92.

Figure 3:
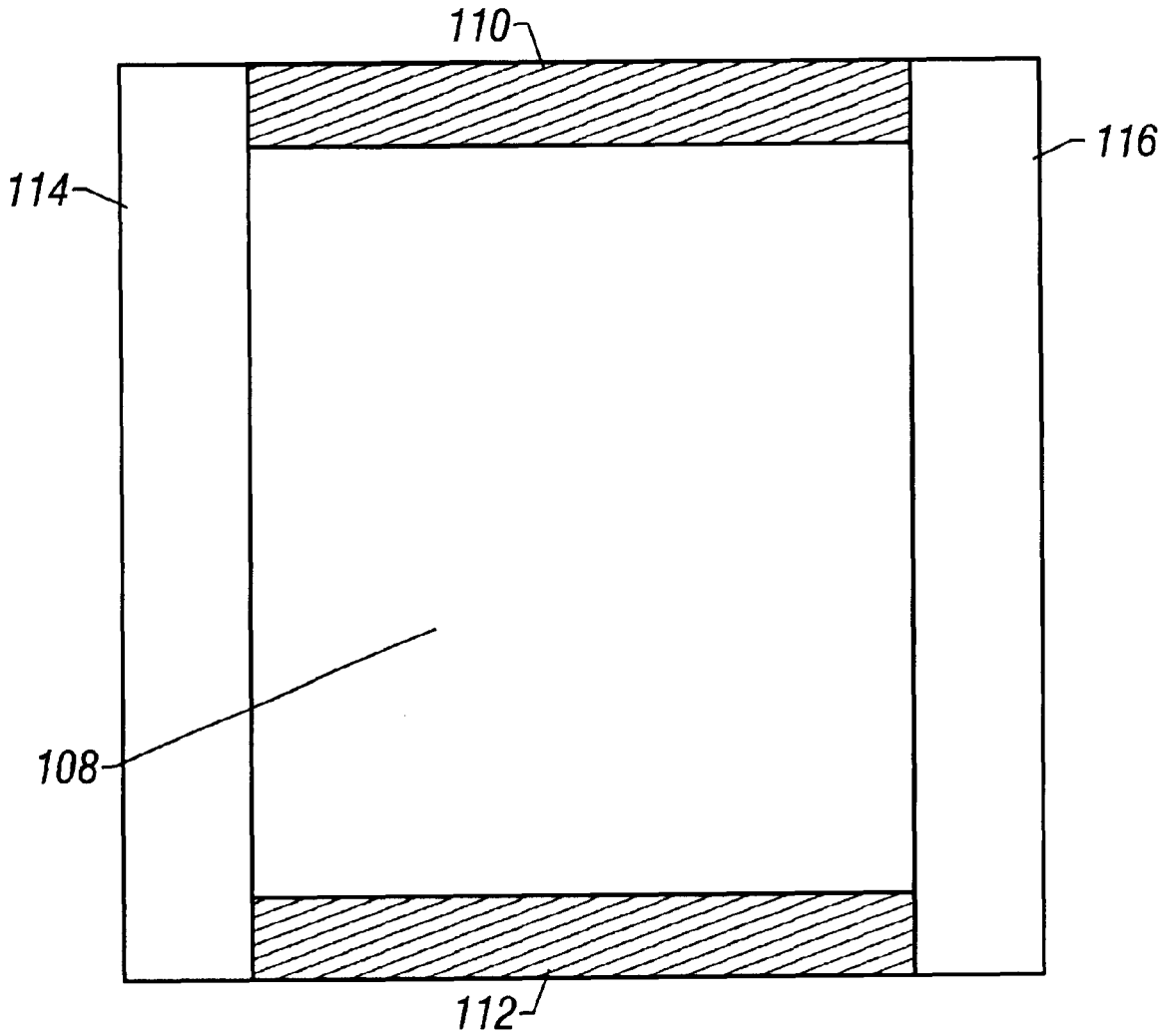
FIG. 3 is an end view of the bore of the railgun of FIG. 2.

FIG. 3 is a end view of the railgun 92 of FIG. 2. The bore 108 is enclosed by the two conducting rails 110, 112 and by two insulating rails 114, 116. In some embodiments, the conducting rails 110, 112 are made of copper, and the insulating rails 114, 116 are made of either polycarbonate or ceramic. In the embodiments illustrated below, the interior of the bore 108 has a square cross-section having the dimensions of about 0.5 inches by 0.5 inches. Other embodiments employ bores 108 having different dimensions and different cross-sectional shapes, e.g., a circular or otherwise curved cross-sectional shape. As is explained below, the length of the rails 110, 112 effects the obtainable terminal velocity for the powder particles.

Figure 4:
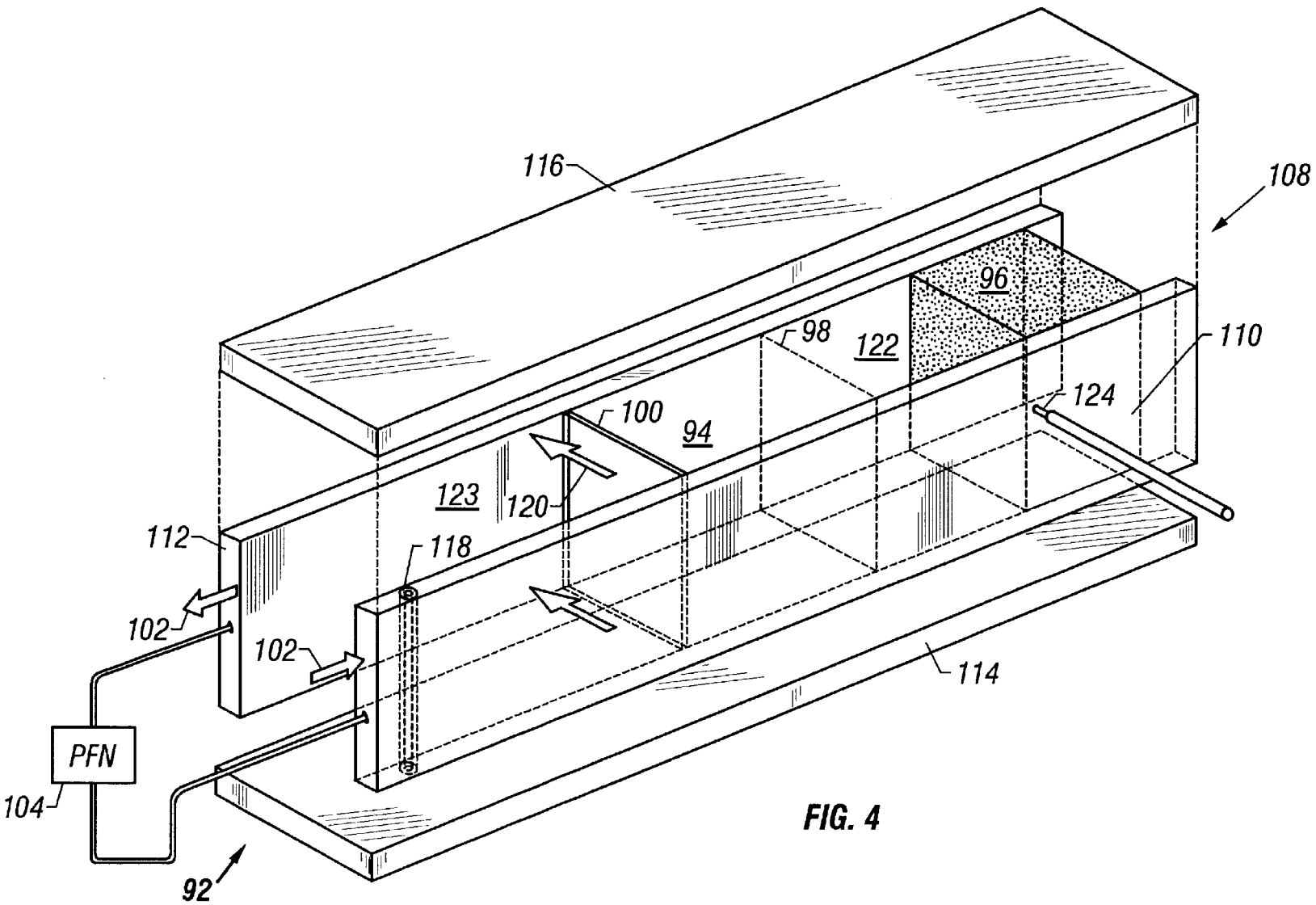
FIG. 4 is a blowup view of the railgun of FIG. 2.

FIG. 4 is a blowup view of the railgun 92 of FIG. 2. A pulse-forming network (PFN) 104 produces the current pulse 102 in first and second conducting rails 110, 112 of the railgun 92. The current pulse 102 has a high amperage and a short duration as is described below. The current pulse 102 flows out along the first conducting rail 110 and returns along the second conducting rail 112.

Referring to FIGS. 2 and 4, the plasma armature 100 is a planar sheet-like formation of ionized ambient gas that spans substantially the entire cross-section of the bore 108 of the railgun 92. The sheet-like plasma armature 100 and the rails 110, 112, 114, 116 form a substantially sealed piston structure for accelerating and compressing ambient gas 122 to form the compressed column of gas 94 of FIG. 2. Since the plasma armature 100 extends between the first and second conducting rails 110, 112, the plasma armature 100 also conducts a current 120 between the two rails 110, 112 thereby closing the circuit for the current pulse 102. An arc initiator 118, forms the plasma armature 100 near one end of the bore 108 by ionizing a portion of the ambient gas 123 in the bore 108 of the railgun 92.

In some embodiments, the railgun 92 operates at atmospheric pressure, i.e. the ambient gas 122, 123 is at atmospheric pressure. The ambient gas 122, 123 may be an inert gas such as argon. An inert gas lowers the risk of oxidation of either the target surface (not shown) or the powder particles with the heated gas of the compressed column 94. Some embodiments use known techniques to bath the area surrounding the target surface with inert gas. The bath of inert gas may be used to reduce oxidation of the powder particles and/or of the target surface, because oxidation might otherwise interfer with the binding of the powder particles to the target surface.

Referring to FIG. 2, a powder feeder 126 introduces powder particles into a drift region 128 of the bore 108 of the railgun 92 through one or more injection ports 124. One embodiment uses a Metco 4MP-Dual powder feeder that can feed powder at a rate of 24 grams per minute. In this embodiment, the drift region 128 has a volume of about 4.13 cubic inches, and the Metco powder feeder can fill the drift region 128 so that the average inter-particle spacing is about ten particle diameters. The compressed column of gas 94 moves through the drift region 128 at supersonic speeds. For particle densities that do not interfere with the gas flow, the particles of the powder cloud 96 can be accelerated to supersonic velocities by drag forces generated by the supersonic gas flow.

Figure 5:
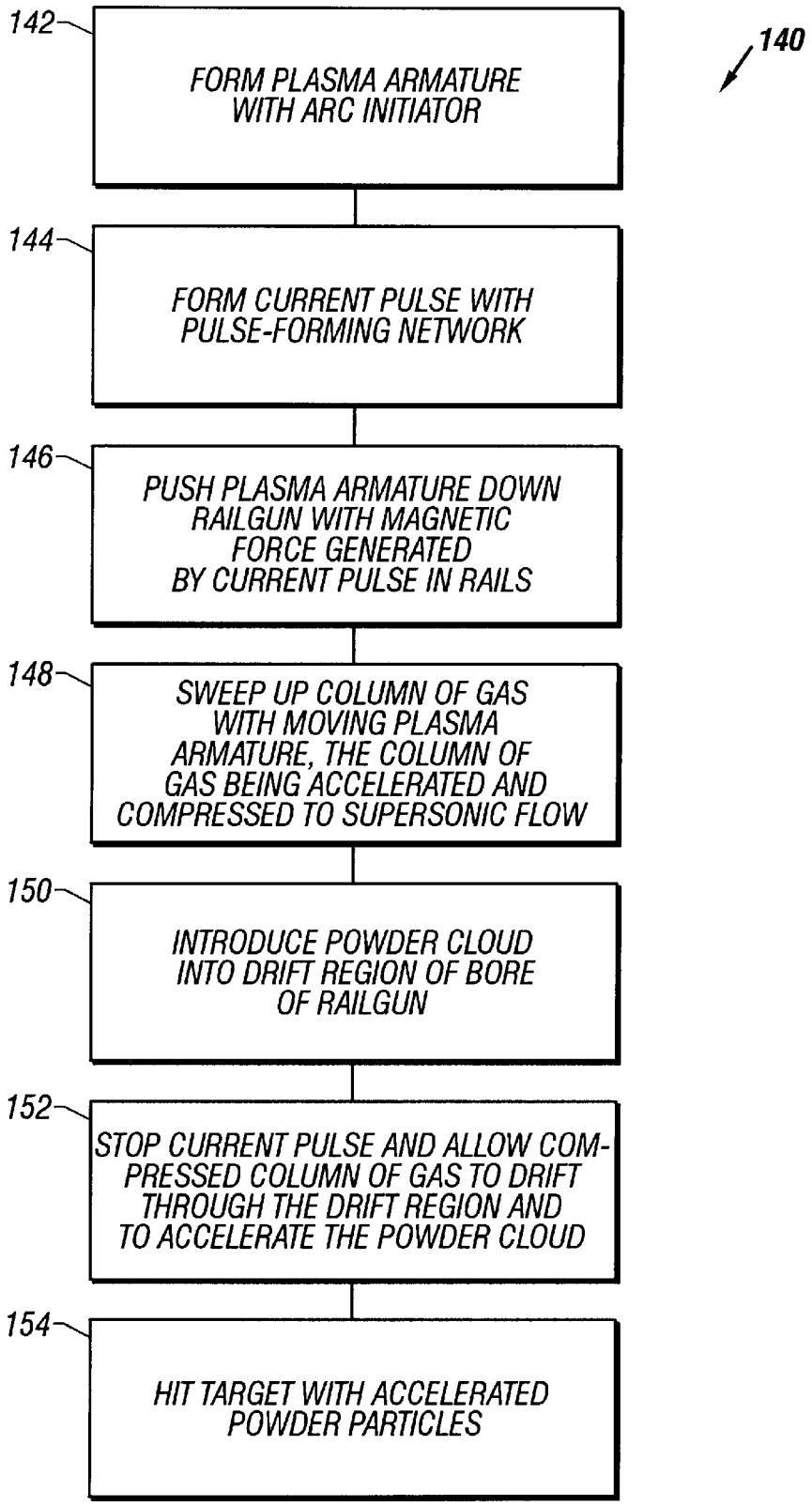
FIG. 5 is a flowchart illustrating the steps of a method for performing electromagnetic powder deposition with the railgun of FIG. 2.

FIG. 5 illustrates a flowchart for a method 140 of performing electromagnetic powder deposition (EPD) with the railgun 92 of FIGS. 2–4. At block 142, the arc initiator 118 forms the plasma armature 100 by ionizing a region of the ambient gas 123. At block 144, the PFN 104 starts transmitting the current pulse 102 to the first conducting rail 110. The current 102 travels down the first conducting rail 110, travels across the plasma armature 100, and returns to the PFN 104 by the second rail 112. From Ampere's Law, the current 120 of the plasma armature 100 is subject to a magnetic force produced by the currents 102 in the two conducting rails 110, 112. At block 146, the magnetic force pushes the current 120 and the plasma armature 100 down the bore 108 of the railgun 92.

At block 148, the moving plasma armature 100 sweeps up the column of gas 94. The ambient gas 122 is accelerated to supersonic velocities and compressed by the supersonic shock front 98. The length of the compressed column of gas 94 increases as more ambient gas 122 is swept up by the moving shock front 98. At block 150, the powder cloud 96 is introduced into the drift region 128 of the bore 108. At block 152, the PNF 104 stops transmitting the current pulse 102, and the compressed column of gas 94 continues to drift down the bore 108 through previously acquired inertia. The compressed column of gas 94 moves through the powder cloud 96 accelerating the particles through viscous drag forces. At block 154, the accelerated powder particles impact on the substrate of the target to be plated.

Referring to FIG. 5, one embodiment for the PFN 104 of FIGS. 2 and 4 starts the transmitting of the voltage pulse that generates the current pulse 102 of block 144 prior to the formation of the plasma armature 100, in block 146. This reduces delay periods in which the plasma armature 100 may degrade due to plasma instabilities. The inductance between the PFN 104 and the gun should be minimized so that the current rise is short compared to plasma instability formation times. In blocks 146 and 148, the plasma armature approaches its terminal velocity quickly. After the acceleration and compression stages of blocks 146 and 148, the plasma armature 100 may be allowed to extinguish, because the compressed column of gas 94 of FIG. 2 will continue to advance through the drift region 128 and accelerate the powder particles with previously acquired momentum.

3. Operating Parameters—Gas Compression, Railgun Current, and Railgun Length Referring to FIGS. 2 and 4, the current pulse 102 and the length of the bore 108 are selected so that the armature 100 quickly attains a supersonic velocity. Then, the column of gas 94 generates the shock front 98 which compresses the ambient gas 122 swept up to a higher density. The dynamics of the plasma armature 100 and the compressed column of gas 94 can be approximately described by the Newtonian equation:

$$d/dt\ (MV_G)=\tfrac{1}{2}L'I^2. \tag{7}$$

Here, L' is the inductance gradient along the railgun 92 related to the current, I, circulating in the conducting rails 110, 112, i.e. the currents 102 of FIG. 2. M and $V_G$ are the mass and velocity of the combined system composed of the plasma armature 100 and the compressed column of gas 94. After the initial acceleration period. $V_G$ is approximately the velocity of the compressed column 94 of gas itself. Providing that the rise time for the current pulse 102 is sufficiently short and the amplitude of the pulse is substantially constant, the time integration of equation (7) yields:

$$M V_G = \tfrac{1}{2} L' I^2 t. \quad (8)$$

If the mass $M_A$ of the plasma armature 100 does not change substantially during the acceleration, the mass of the combined system composed of the plasma armature 100 and the compressed column of gas 94 increases as more of the ambient gas 122 is swept up. Then, the mass M satisfies the equation:

$$M = M_A + \rho_0 A Z. \quad (9)$$

Here, Z is the distance that the plasma armature 100 has moved, and $\rho_0$ is the density of the ambient gas 122. From equation (9), the dynamical equation (8) can be fully integrated to obtain Z:

$$\rho_0 A Z^2 + 2 M_A Z = \tfrac{1}{2} L' I^2 t^2. \quad (10)$$

Thus, the position Z of the plasma armature 100 is:

$$Z = \sqrt{Z_A^2 + \frac{L' I^2 t^2}{2\rho_0 A}} - Z_A \text{ with } Z_A \equiv M_A/(\rho_0 A). \quad (11)$$

Equation (11) illustrates that specific embodiments can be constructed so that velocity of the combined system composed of the plasma armature 100 and the compressed column of gas 94 quickly approaches a terminal velocity given by:

$$V_{G,terminal} = I\sqrt{\frac{L'}{2\rho_0 A}}. \quad (12)$$

Upon nearing the terminal velocity, $V_{G,\ terminal}$, the shock front 98 continues to sweep up the ambient gas 122 at an approximately constant rate.

Equation (12) illustrates that increasing the inductance gradient, L', of the conducting rails 110, 112 enables obtaining a higher $V_{G,\ terminal}$'S with lower gun currents I. Some embodiments may use an augmented turn railgun, i.e. a railgun having parallel and cross-connected conducting rails, to increase L' and lower the gun current I required to obtain a given $V_{G,\ terminal}$.

Referring to FIG. 2, the compression factor for the column of gas 94 can be estimated in the strong shock limit, i.e. for $V_{G,\ terminal} >> c_S$ with $c_S$ the velocity of sound. In the strong, shock limit, the compression ratio is given by:

$$\frac{\rho_G}{\rho_0} = \frac{\gamma+1}{\gamma-1}. \quad (13)$$

with $$\gamma = \frac{C_P}{C_V} = \text{specific heat ratio for the plasma.}$$

For argon gas at room temperature and atmospheric pressure, the specific heat ratio $\gamma$ is about 1.4 and the density is about 1.78 milligrams per cubic centimeter and the compression factor, from equation (13), is about equal to six. This is equivalent to a compressed density of about 0.0107 grams per cubic centimeter. In the strong shock limit, the ambient gas 122 is substantially compressed by the shock front 98, e.g., by a factor of six for argon and by a factor of greater than three for other inert ambient gases.

The value of the final velocity of the powder particles is fixed by plating considerations. Some embodiments are constructed to attain final particle velocities, $V_P$, in excess of 2 kilometer per second. At such high velocities, the kinetic energies may be double the energy of fusion for most metals, and many other materials. The powder particles may be made of metals, e.g., titanium, Inconel, chromium, or of non-metals, e.g., insulators such as tungsten carbide. If the kinetic energies of the powder particles is twice the latent heat of fusion, the powder particles are melted by impact and fused to the substrate. For the above-mentioned powder materials, terminal velocities satisfying the relation:

$$\text{Specific Kinetic Energy} = \frac{1}{2}V_P^2 = \frac{2\Delta H_{fusion}}{M_P} = 2.2\,\text{kJoules/gram} \quad (14)$$

are sufficient to melt the powder particles on impact. Such an impact may also cause the melting of a quantity of the substrate substantially comparable in mass to the impacting powder particle's mass, i.e. between about 0.5 and 1.0 times the mass of the impacting powder particle in some embodiments. For the above-mentioned materials, this requires that $V_P \cong 2.1$ kilometers per second. In embodiments that accelerate the particles of the powder cloud 96 to about half the terminal velocity of the gas, the gas column 94 needs to attain a velocity $V_{G,\ terminal}$ of about 4.2 kilometers per second to melt the powder particles on impact.

Referring to FIG. 2, the above results and equation (6) enable an estimation of the lengths needed for the compressed column of gas 94 and for the railgun 92. If Inconel particles having a diameter of 100 micro-meters and a density of about 8.3 grams per cubic centimeter are used for plating, a final velocity of about 2.1 kilometers per second may be obtained if the compressed column of gas 94 has a length $L_G$ that satisfies:

$$L_G \geqq 7.2 \text{ cm}. \quad (15)$$

Since the supersonic plasma armature 100 can compress ambient argon gas by factor of about six, the length of the column of gas 94 before being compressed is about six times $L_G$. If the column of argon 94 is compressed before accelerating the powder cloud in the drift region 128, the length, $L_{railgun}$ of the railgun 92 needs to satisfy:

$$L_{railgun} \geqq 6 \times 7.2cm + 7.2cm \approx 50cm. \quad (16)$$

The illustrative embodiments use railguns 92 that are, at least, 50 cm long.

The length of the compressed column of argon gas 94 allows an estimate for the duration, $T_{power}$, and the amplitude, I, of the current pulse 102 that powers the compression. If the combined system composed of the plasma armature 100 and the compressed column of gas 94 rapidly approaches $V_{G,\ terminal}$, $T_{power}$ approximately satisfies:

$$T_{power} = \frac{L_{railgun}}{V_{G,terminal}} \cong 120 \text{ micro-seconds}. \quad (17)$$

Equation (12) shows that smaller cross-sectional areas A and higher inductance gradients L' enable the same $V_{G,\ terminal}$ to be obtained with a smaller amplitude current, I, for the current pulse 102. For the ½ inch×½ inch square bore geometry of FIGS. 2–4, A is equal to 1.613 centimeters squared and the inductance gradient L' is about 0.5 micro-Henry per meter for non-augmented railguns. From equation (12), the amplitude, I, of the current pulse 102 and $V_{G,\ terminal}$, for the above-described geometry, satisfy:

$$I = V_G\sqrt{\frac{2\rho_0 A}{L'}} \approx 150{,}000 \text{ amps.} \tag{18}$$

The PFN 104 of the illustrative embodiments produces a current pulse having duration and amplitude values substantially given by equations (17) and (18).

Referring to FIGS. 2–4, the total impedance of the railgun 92 determines the voltage requirements for the PFN 104. The total impedance includes a time varying resistance and a time varying inductance, because the motion of the plasma armature 100 changes the length of the conducting rails 110, 112 through which the current 102 flows. The resistive component of the impedance comes from both the skin depth resistance, $R_{skin}$, of the two conducting rails 110, 112 and the resistance, $R_{arc}$, of the plasma armature 100. If the plasma armature 100 rapidly approaches the terminal velocity, $V_{G,\ terminal}$, the resistive component of the impedance is approximately given by:

$$R=R_{arc}+R_{skin}Z. \tag{19}$$

The skin depth resistance, $R_{skin}$, of 0.5 inch wide copper rails is:

$$R_{skin} \equiv \frac{\sqrt{2\mu_0\eta}}{\sqrt{AT_{power}}} = 1.76 \text{ m}\Omega/\text{meter.} \tag{20}$$

The inductance, $L_{rails}$, is also approximately a linear function of the distance, Z, through which the plasma armature 100 has moved:

$$L_{rails}=L'Z. \tag{21}$$

L' is the inductance gradient. The voltage, V, generated by the PEN 104 satisfies:

$$V=RI+d/dt(L'ZI)=(R+L'V_{G,\ terminal})I. \tag{22}$$

The last equality of equation (22) assumes that the current pulse 102 has an approximately constant amplitude, I, and also assumes a short time for the plasma armature 100 to approach the terminal velocity, $V_{G,\ terminal}$. Equation (22) shows that the railgun 92 represents a substantially resistive load to the PFN 104. The equivalent resistance, $R_{railgun}$, is given by:

$$R_{railgun}=R_{arc}+R_{skin}Z+L'V_{G,\ terminal}. \tag{23}$$

The constant velocity of the plasma armature 100 makes the inductive contribution $L'V_{G,\ terminal}$ appear as a constant resistance to the PFN 104.

Referring to FIGS. 2 and 4, the parameters of the above-described embodiment allow a calculation of the resistance that the railgun 92 represents to the PFN 104. $L'V_{G,\ terminal}$ is approximately 2.1 mΩ for 0.5 inch wide copper rails and $V_{G,\ terminal}$=4.2 kilometers per second. The arc resistance $R_{arc}$ is a fairly constant value of 1 mΩ. Near the end of the 120 micro-second current pulse 102, the size of skin term $R_{skin}$ becomes comparable to the inductive term. At earlier times the effective resistance is substantially constant. Thus, $R_{railgun}$ represents a resistive load of about 3–4 mΩ to the PFN 104 over the range of motion of the plasma armature 100.

Figure 6:
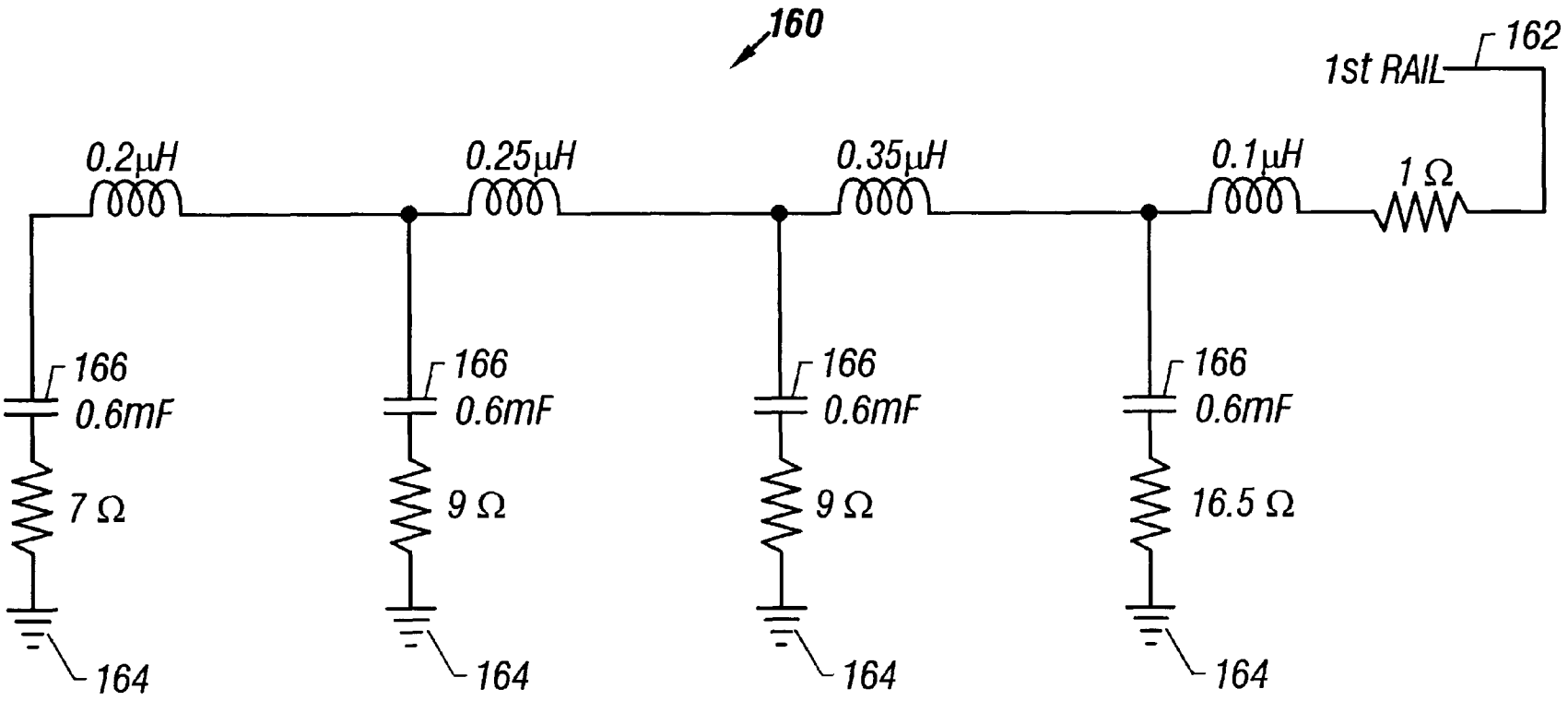
FIG. 6 is an embodiment of a pulse-forming network adapted to powering the plasma armature in the railgun of FIG. 2.

FIG. 6 illustrates one embodiment 160 for the PFN 104 of FIG. 2 that satisfies the above-described requirements for the current pulse 102 of the railgun 92, of FIGS. 2 and 4, in which the total impedance is resistive and equal to about 3 to 4 mΩ. The first rail 110 of FIG. 2 connects electrically to the output line 162 and the second rail 112 attaches to the common ground 164 attached to each of four capacitors 166. The four capacitors 166 have a capacitance of about 0.6 milli-Farads each and form an inductive-capacitive circuit between the output line 162 and the common ground 164.

Figure 7:
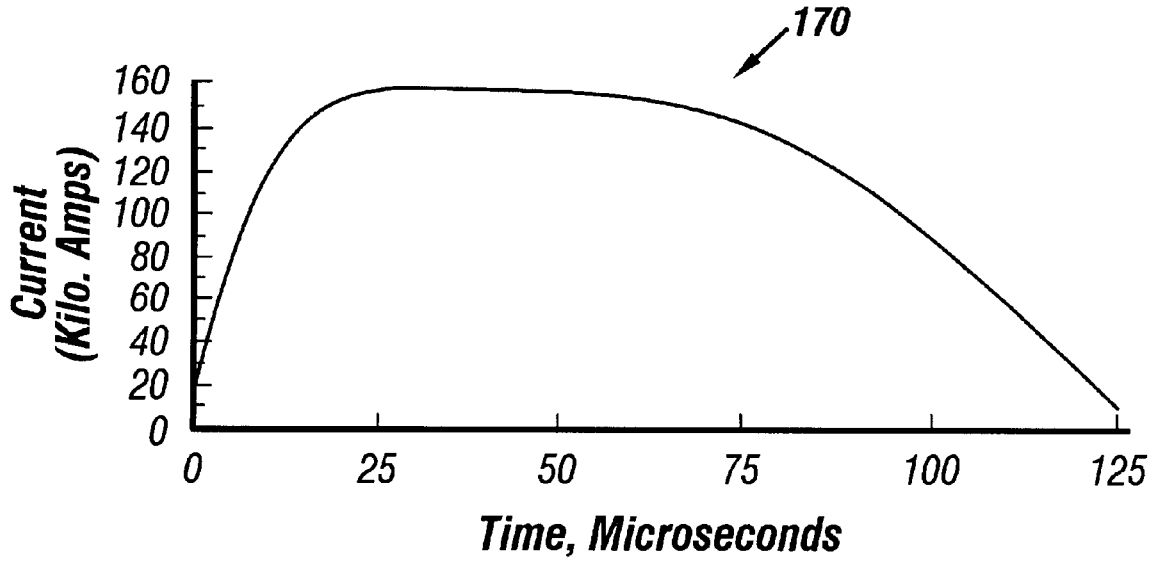
FIG. 7 shows the current pulse produced by the pulse-forming network of FIG. 6.

FIG. 7 shows the current pulse 170 that the PFN 160 of FIG. 6 produces in a railgun having an equivalent impedance that is resistive and has a value of about 3 to 4 milli-ohms. The current pulse 170 has a rise time of less than 25 micro-seconds, a substantially constant period of about 95 micro-seconds, a total duration of about 120 micro-seconds, and a peak amplitude of about 150,000 amps. The current pulse 170 can accelerate the plasma armature 100 of FIG. 2 to close to $V_{G,\ terminal}$ in about 20 μsec. The short acceleration period and the short total pulse duration, i.e. 100–300 micro-seconds, reduces the effects of plasma instabilities on the plasma armature 100.

4. Recharge System for PFN

Figure 8:
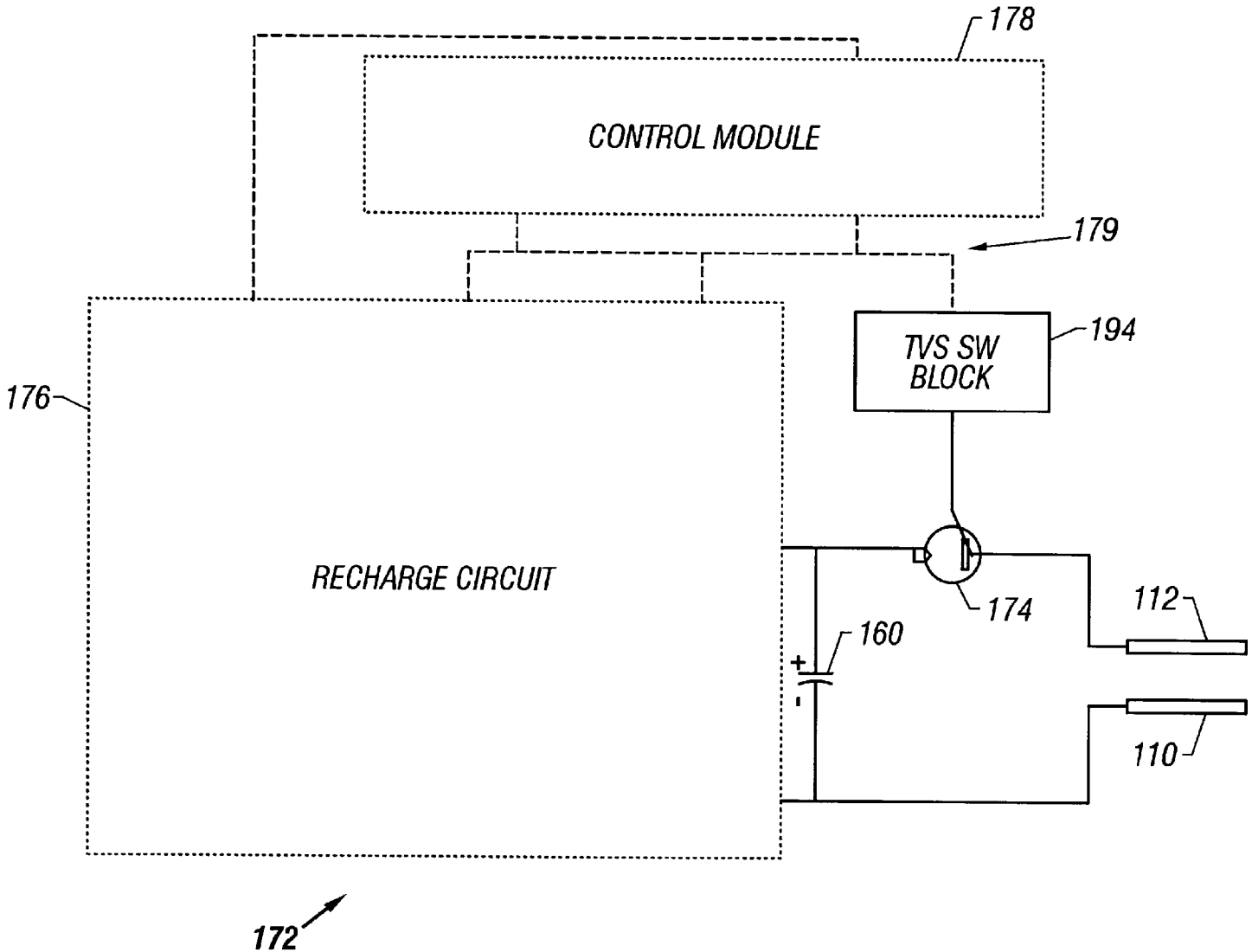
FIG. 8 shows a recharge system for use with the pulse-forming network of FIG. 6.

FIG. 8 shows a recharge system 172 for the PFN 160 of FIG. 6. The system 172 includes a control switch 174, a recharge circuit 176, and an "isolated" control module 178. The control switch 174 controls the start and stop of the current pulses 102 of FIG. 2. In one embodiment, the control switch 174 is a triggered vacuum switch (TVS). The control module 178 operates both the control switch 174 and the recharge circuit 176. The control module 178 is electrically isolated from currents in the PFN 160, the control switch 174 and the recharge circuit 176. In one embodiment, lines 179 between the control module 178, the control switch 174, and the recharge circuit 176 are non-conductive optical fibers.

Figure 9:
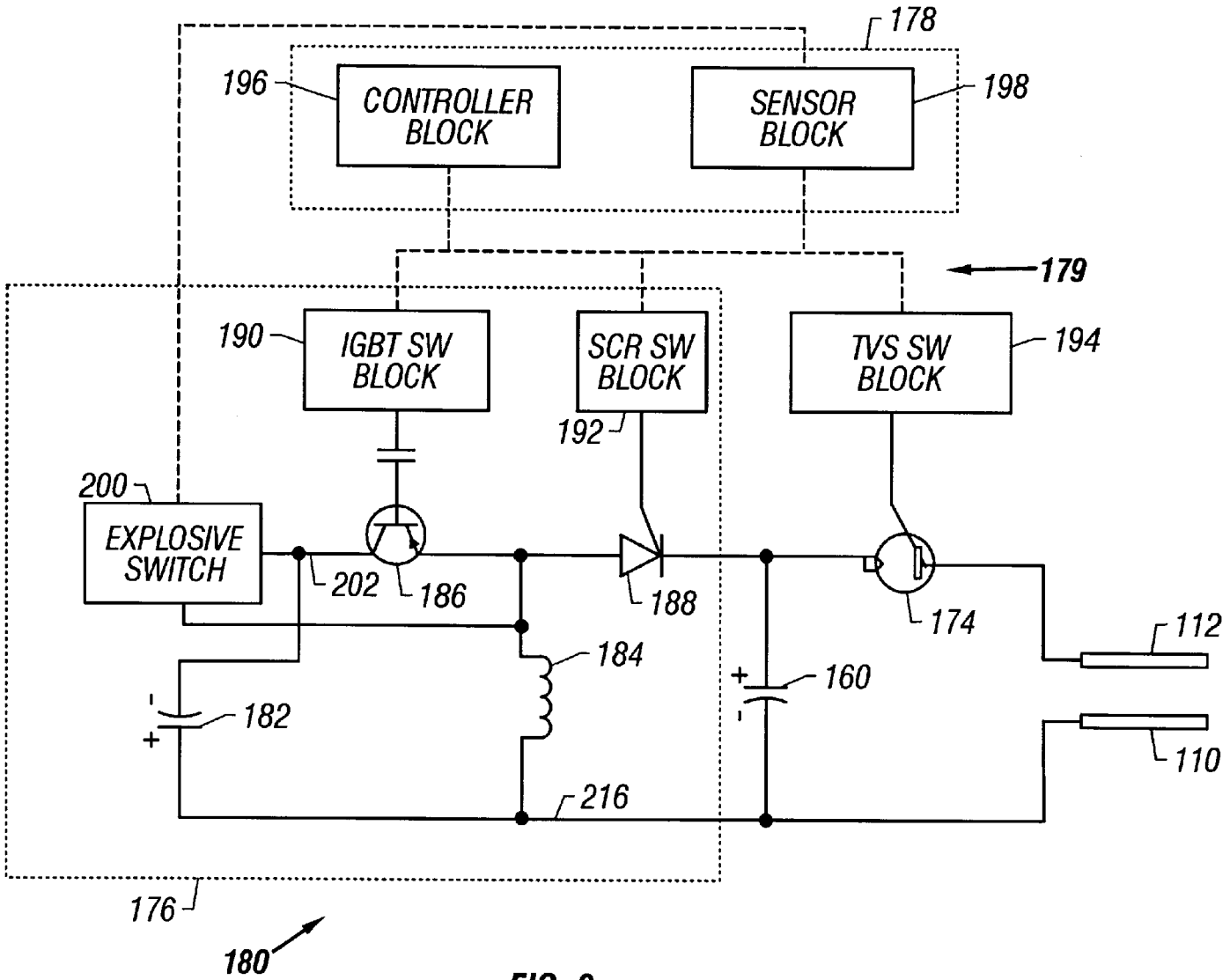
FIG. 9 illustrates one embodiment for the recharge circuit and the control module employed by the recharge system of FIG. 8.

FIG. 9 illustrates an embodiment 180 of the recharge circuit 176 that employs a recharge capacitor bank 182 and a charging inductor 184 to power and regulate the recharge cycles. A bank of bipolar transistors (IGBT) 186 having isolated-gates controls the current flow from the recharge capacitor 182 to the charging inductor 184. The collectors and emitters of the IGBT's 186 are connected in series. A series bank of silicon controlled rectifiers (SCR's) 188 insures that the charging current from the recharge capacitor bank 182 does not pass through the PFN 160 by having symmetrical voltage holdoff. The bank of IGBT's 186, the bank of SCR's 188, and the control switch 174 each have separate switch blocks 190, 192, 194. The switch blocks 190, 192, 194 provide gate signals in response to optical signals from the controller block 196. The control module 178 also includes a sensor block 198 to shut the PFN 160 and/or the recharge circuit 176 down in response to preselected types of errors. One preselected error is the non-opening of the IGBT's 186, i.e. an error that exposes the six high powered IGBT's 186 to excessive current. In response to this error the sensor block 198 sends a signal to explode the switch 200 thereby closing a path around the IGBT's 186 through the explosive closing switch 200.

Figure 10:
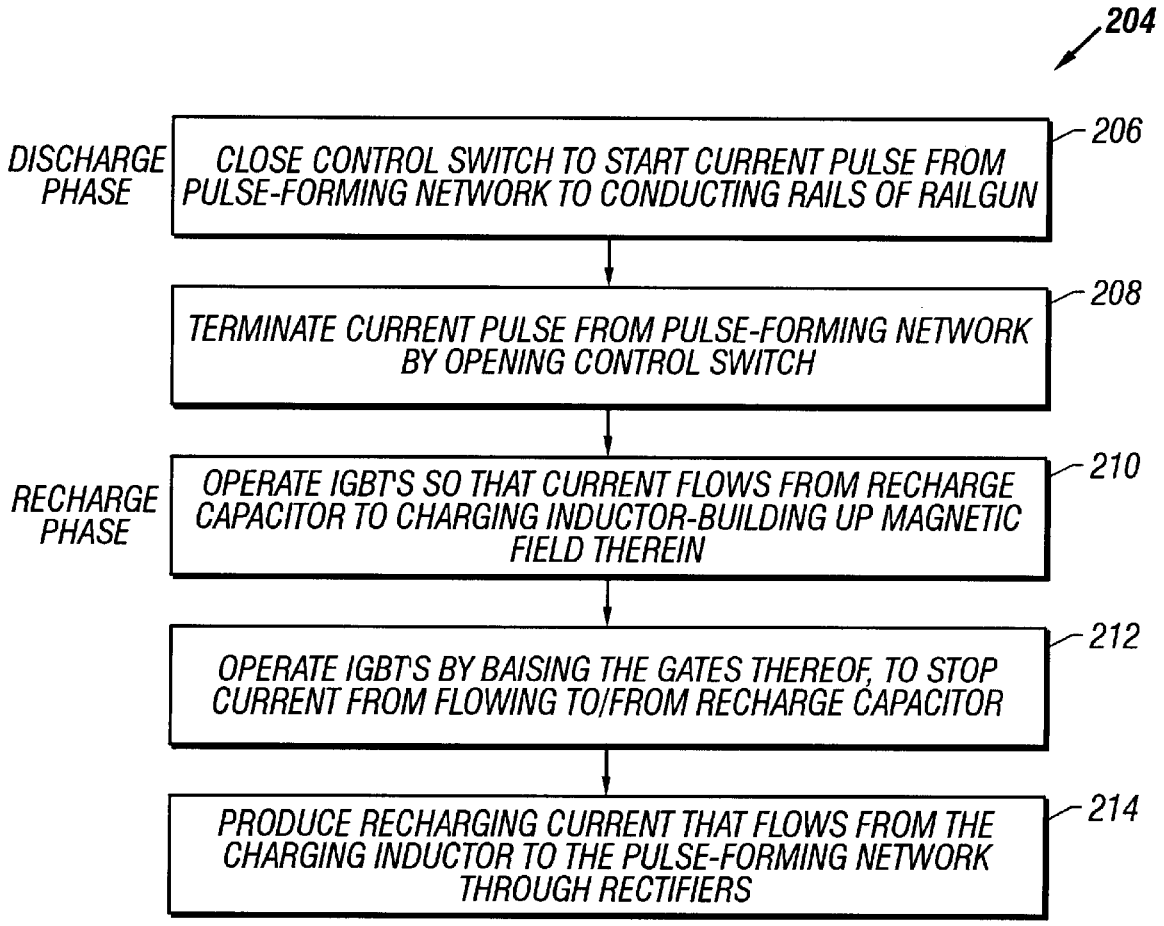
FIG. 10 is a flowchart of the steps of a method for recharging the pulse-forming network of FIG. 6 with the recharge system of FIGS. 8 and 9.

FIG. 10 is a flowchart of a method 204 for operating the recharge system 172 of FIG. 9. At block 206, the controller block 196 closes the control switch 174 and the PFN 160 starts the current pulse 170 of FIG. 7 that drives the plasma armature 100 down the bore 108 of railgun of FIG. 2. At block 208, the controller block 196 opens the control switch 174 terminating the current pulse 170 of FIG. 7. This ends the discharge stage and starts the recharge stage to prepare for the next plasma armature 100 to be accelerated down the railgun 92 of FIG. 2. At block 210, the controller block 196 operates the gates of the IGBT's 186 to allow a current to flow from the recharge capacitor 182 to the charging inductor 184. The current builds up the magnetic field in the charging inductor 184. The bank of SCR's 188 stops a current flow that would otherwise simultaneously charge the PFN 160 at block 210. At block 212, the controller block 196 biases the gates of the IGBT's 186 to stop further current flow in the circuit 202. At block 214, the charging inductor 184 produces a current that flows in the circuit 216 of FIG. 9 in response to the SCR's 188 gated into the conducting state and the IGBT's 186 no longer allowing current to flow back to the recharge capacitor 182. The SCR's 188 allow the magnetic energy stored in the charging inductor 184 to produce a current that flows from the charging inductor 184 to the PFN 160 thereby recharging the PFN 160. The two stage recharging cycle of blocks 210, 212, and 214 uses the impedance of the charging inductor 184 to act as a controller of current levels and recharging speeds.

In specific embodiments, the blocks 190, 192, 194 are galvanically isolated from the other blocks 190, 192, 194, the control module 178, and grounds (not shown). Low power electrical requirements for the blocks 190, 192 are provided by lithium batteries (not shown), and higher power requirements are provided by individual motor-alternators (not shown). All control and sensory communications are transmitted with the fiber optic lines 179. This reduces spurious signals generated by the high electromagnetic fields during the recharge and discharge cycles of FIG. 10. All of the electronics 190, 192, 194, and 178 are housed in Faraday shields. In some embodiments, the logic in the blocks 190, 192, 194 and the control module 178 employ programmable hardware built with voltage comparators (not shown).

The size of the recharge capacitor 182 of FIG. 9 determines the number of discharges that the railgun 92 of FIGS. 2–4 can perform without substantial down time. The recharge circuit 176 of FIG. 9 can provide up to 10 discharges, at a 30 Hertz rate if the recharge capacitor 182 has a capacitance of about 28 milli-farads. In other embodiments, the recharge system 172 of FIG. 8 provides more discharges, at the rate of 30 Hertz, by increasing the capacitance of the recharge capacitor 182 of FIG. 9. For example, by increasing capacitance of the recharge capacitor 182 with additional capacitors connected in parallel (not shown), 100 or more discharges can be obtained without substantial down time. The recharger circuit 180 of FIG. 9 described hereabove has been employed for laboratory tests of principles involved. A production system (not shown) could employ a continuous duty power supply (not shown) to operate the electromagnetic powder deposition system for long coating intervals. The invention is intended to cover all variations of the recharge system 172 that an ordinary person in the art having the knowledge of the present disclosure could construct and use without undue experimentation.

5. Initiator For The Plasma Armature

Figure 11A:
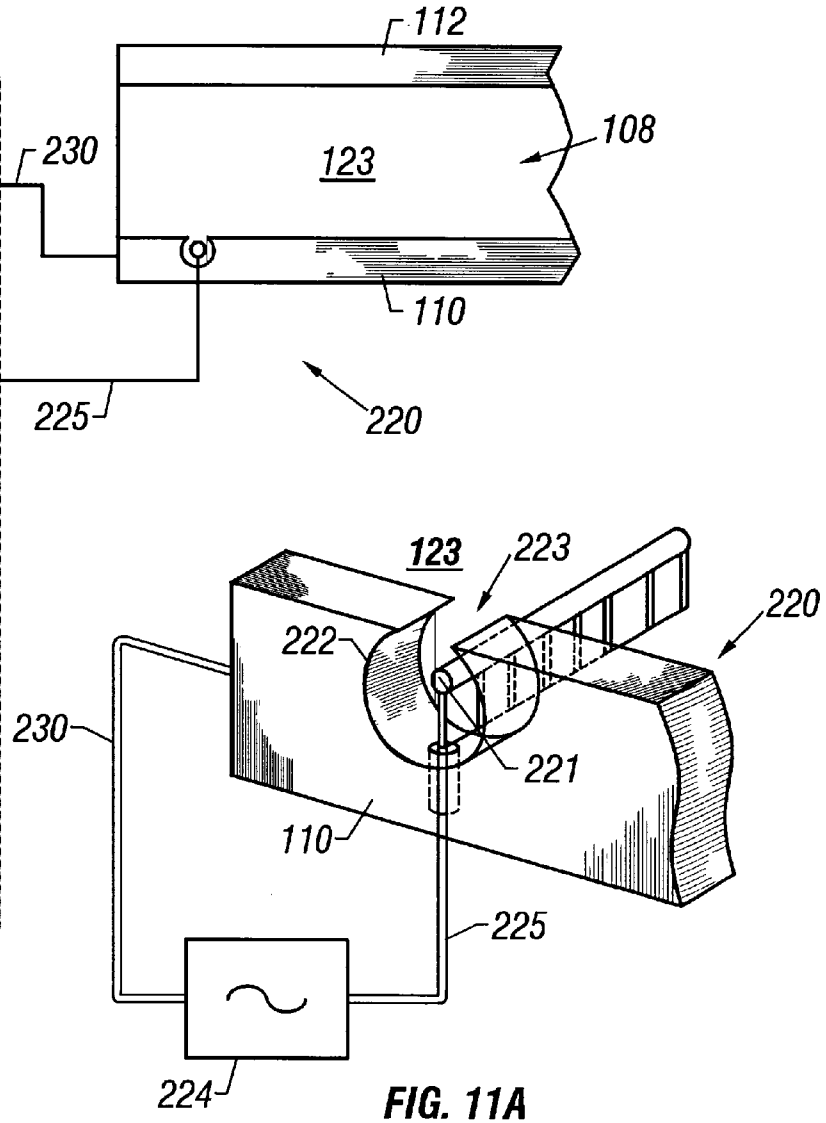
FIG. 11A illustrates an embodiment for an arc initiator for forming the plasma armature of the railgun illustrated in FIGS. 2 and 4.

FIG. 11A illustrates an embodiment 220 for the arc initiator 118 for the plasma armature 100 of FIG. 2. The arc initiator 220 has a coaxial geometry that includes a solid wire electrode 221 that is centered in a cavity 222 having a circular cross section. The cavity 222 is filled with the ambient gas 123 that fills a portion of the railgun 92 of FIGS. 2 and 4. The cavity 222 has a narrow slit 223 that opens along the full width of the bore 108 of the first conducting rail 110 of FIGS. 2–4. In one embodiment, the wire electrode 221 is made of tungsten, the cavity 222 is about 3 millimeters in diameter, and the slit 223 is about 1 millimeter in width. A high-frequency signal generator 224 powers the arc initiator 220 through a first lead 225 connected to the wire electrode 221 and a second lead 230 connected to the conducting rail 110.

Figure 11B:
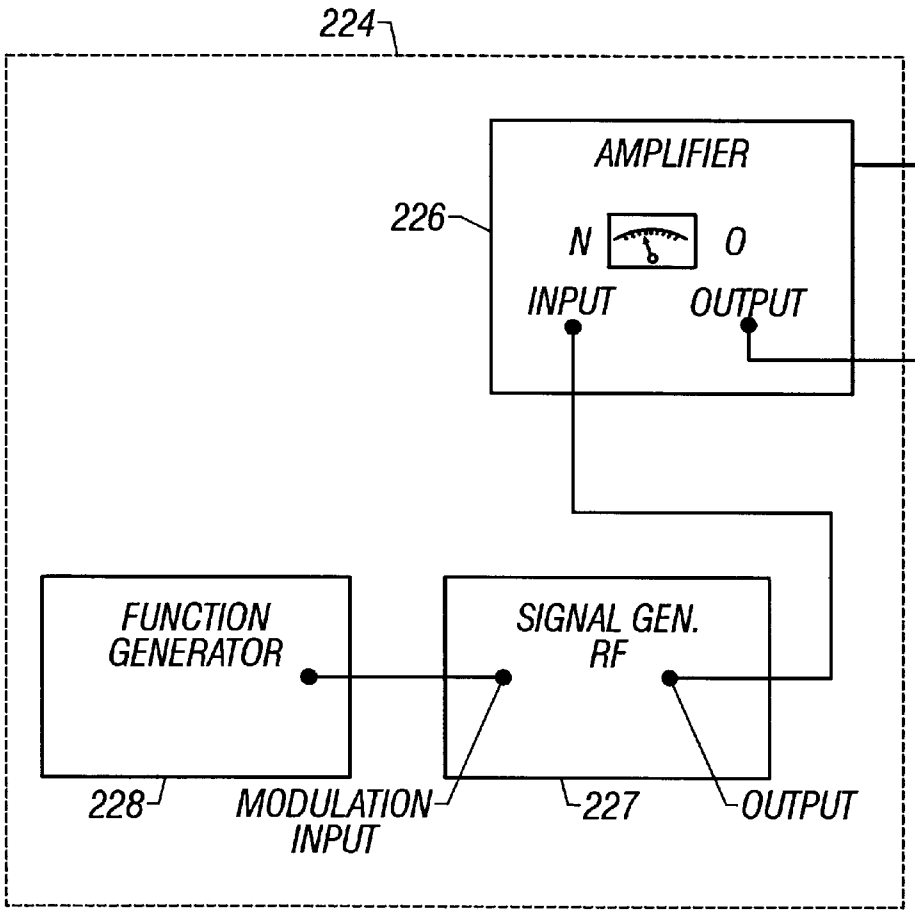
FIG. 11B illustrates a power source for the arc initiator of FIG. 11A.

FIG. 11B illustrates one embodiment of the high-frequency signal generator 224 of FIG. 11A. A radio frequency (RF) amplifier 226, e.g., a model 3200L amplifier built by ENI, Inc., provides RF power to the leads 225, 230 that power the arc initiator 220. The input of RF amplifier 226 receives an input signal from an RF signal generator 227, e.g., a model 8654A built by the Hewlett-Packard Co. A function generator 228, e.g., a model FG 501 A built by Tektronix Inc., modulates the output of the RF signal generator 227.

Still referring to FIG. 11B, illustrative operating parameters are a power signal having a peak amplitude that varies between about 200 and 30 volts from the RF amplifier 226, a modulation signal having a peak amplitude varying between about 1 and 0.2 volts and a frequency of about 40 Mega-Hertz from the RF signal generator 227, and a modulation signal of about 500 Hertz from the function generator 228. In various embodiments, the RF signal has a frequency between 5 and 200 MegaHertz. The function generator 228 modulates the output of the RF signal generator 227 to produce spikes having a peak amplitude about 1 volt and a duration of about 200 micro-seconds separated by regions of about 2 milliseconds in duration where the output of the signal generator 227 has a peak amplitude of about 0.2 volts. The signal powering the arc-initiator 220 has a peak amplitude of about 200 volts for about 200 micro-second intervals separated by 2 millisecond intervals wherein the peak voltage is about 30 volts.

Referring to FIGS. 11A and 11B, at atmospheric pressure, the initiator 220 forms a plasma line that covers substantially the full length of the slit 223 of the railgun 92 of FIGS. 2–4 when the signal generator 224 operates with the above-mentioned illustrative operating parameters for the RF signal applied to the arc initiator 220 and an argon flow rate is about 0.23 cubic meters per hour. Other embodiments may operate the signal generator 224 at about 30–200 Mega-Hertz to form the plasma armature 100 of FIG. 2 at atmospheric pressure. The modulated RF signal can initiate a plasma discharge after the passage of an earlier plasma armature 100 in the railgun 92 of FIGS. 2 and 4.

Referring to FIGS. 2 and 11A, the current pulse 170 of FIG. 7 initiates the plasma armature 100. Instabilities could cause the plasma sheet to collapse to a filamentary form before full generation of compressed column of gas 94. If the plasma armature 100 collapses to a filamentary form, the efficiency of the plasma armature 100 in sweeping out the ambient gas 122, is reduced.

The present invention is intended to include other methods for producing a full bore width line source of plasma, which would be known to a person of ordinary skill in the art providing in light of the present disclosure. These other methods could use lasers, nuclear radiation, and/or electric field to produce the line source of plasma.

6. Diagnostic Tools

Referring to FIGS. 2, 4, and 13A, the operating parameters of the railgun 92 such as $V_P$, $V_G$, $V_{G,\ terminal}$, $P_K$ and the velocity of the plasma armature 100 itself can be measured with pressure transducers 256, optical fibers 252, 254, magnetic probes 242, 244, 246, 248, and high speed cameras (not shown). These measurements may be useful in tuning the railgun 92 and PFN 104 to deliver the $V_P$ desired in specific plating applications.

Figure 12A:
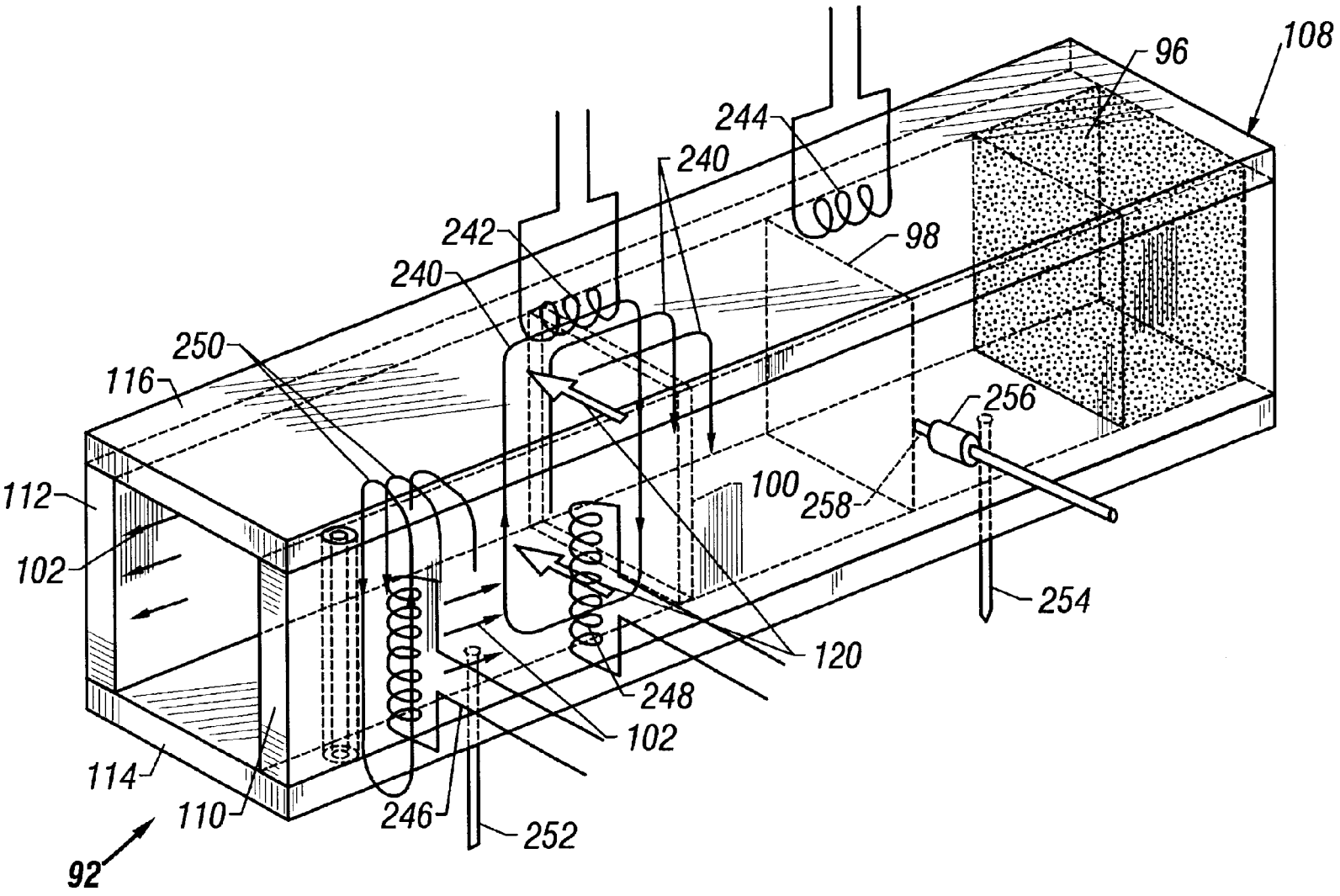
FIG. 12A illustrates a railgun having coil, optical fiber and pressure transducer detectors.
Figure 12B:
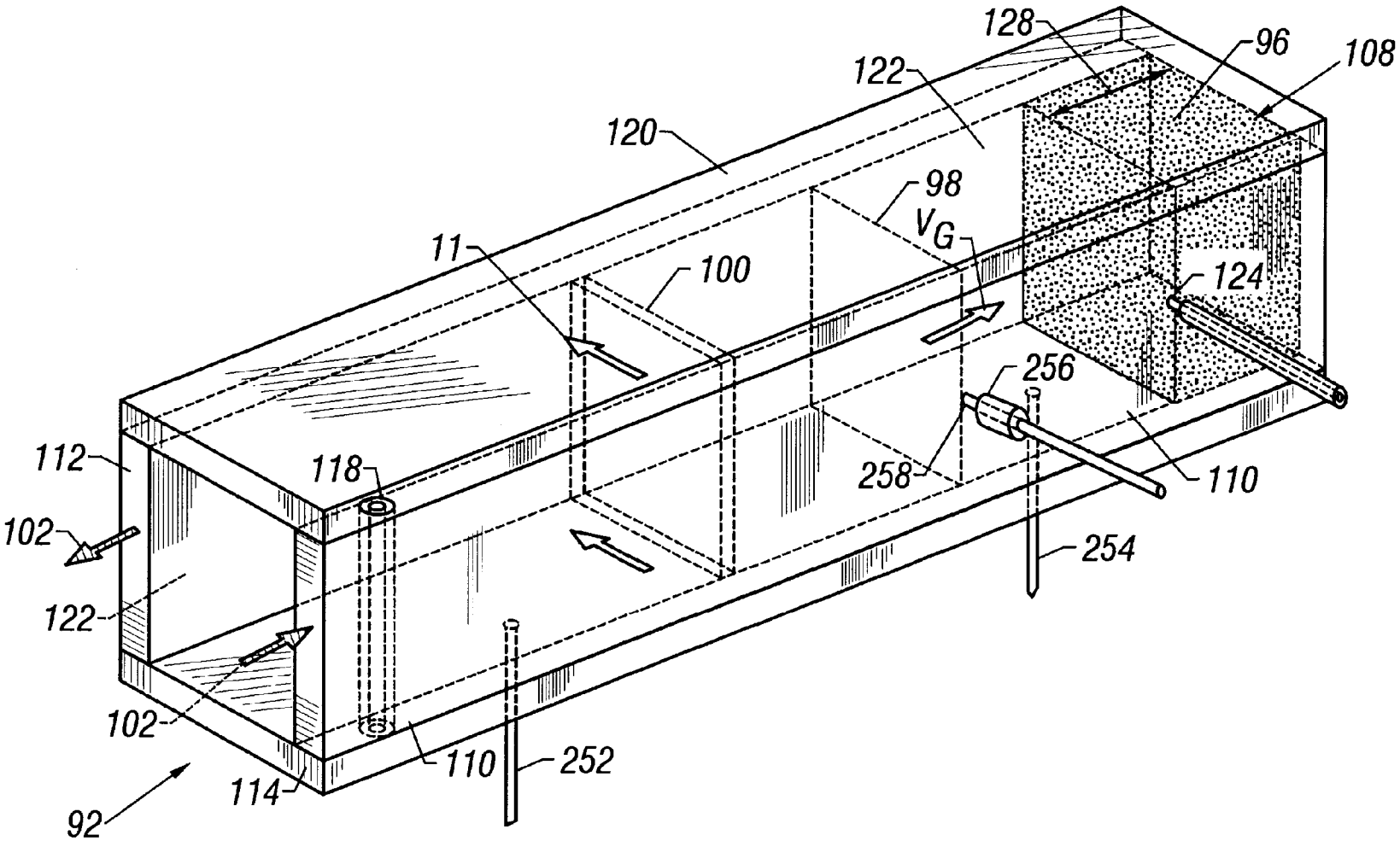
FIG. 12B illustrates a railgun having optical fiber and pressure transducer detectors.

Referring to FIG. 12A, the location and velocity of the plasma armature 100 may be measured by detecting the magnetic field 240 of the current 120 flowing in the plasma armature 100. The magnetic field 240 of the armature current 120 may be measured with the small axial coils 242, 244 placed externally to the bore 108 and parallel to axis of the bore 108. The magnetic field 240 induces a voltage in the axial coils 242, 252 that is proportional to the time derivative of the magnetic flux passing therethrough. When the plasma armature 100 passes the location of the axial coil 242, the induced voltage changes sign. Placing several of the axial coils 242, 244 at different locations enables determining both the position and velocity of the plasma armature 100.

Referring to FIG. 12A, the small radial coils 246, 248 can be positioned perpendicular to the axis of the bore 108 so that the current pulse 102 and magnetic field 250 induced thereby can be measured. The magnetic field 250 produced by the current 102 flowing in the conducting rails 110, 112 of the railgun 92 can be distinguished, by its direction, from the magnetic field 240 due to the current 120 in the plasma armature 100. The voltage induced in the radial coils 246, 248 may be integrated to determine the integrated current that has passed through the rails 110, 112. In some embodiments, the radial and axial coils 246, 248, 242, 244 are located away from electrical buswork of the PFN 104 (not shown) to reduce noise spikes generated by currents therein.

Referring to FIGS. 13A and 13B, some embodiments use transparent polycarbonate as the material for the insulating sidewall 114. First ends of the optical fibers 252, 254 are mounted on the side of the polycarbonate sidewall 114 to receive light from the passing plasma armature 100. The second ends (not shown) of the optical fibers 252, 254 are connected to light-sensing devices (not shown) such as light sensitive diodes (not shown). The sensing devices produce a voltage proportional the light received from the passing armature 100. The optical fibers 252, 254 and sensing devices may be employed to determine the position and velocity of the plasma armature 100. Some embodiments, employ quartz optical fibers and sensing devices sensitive to ultraviolet light emitted by the plasma armature 100 to reduce background noise light. Referring to FIGS. 13A and 13B, some embodiments employ one or more of the pressure transducers 256 to measure the position of the shock front 98. Several holes 258 pierce the sidewalls 110, 114 of FIG. 2 at various distances along the length of the bore 108. The pressure transducers 256 are mounted to detect pressure variations in the holes 258. Some embodiments cover the face of the pressure transducers 256 with Kapton tape to reduce charge coupling to the passing plasma armature 100.

7. Formation of Macro-structures by Electromagnetic Powder Deposition

Figure 13:
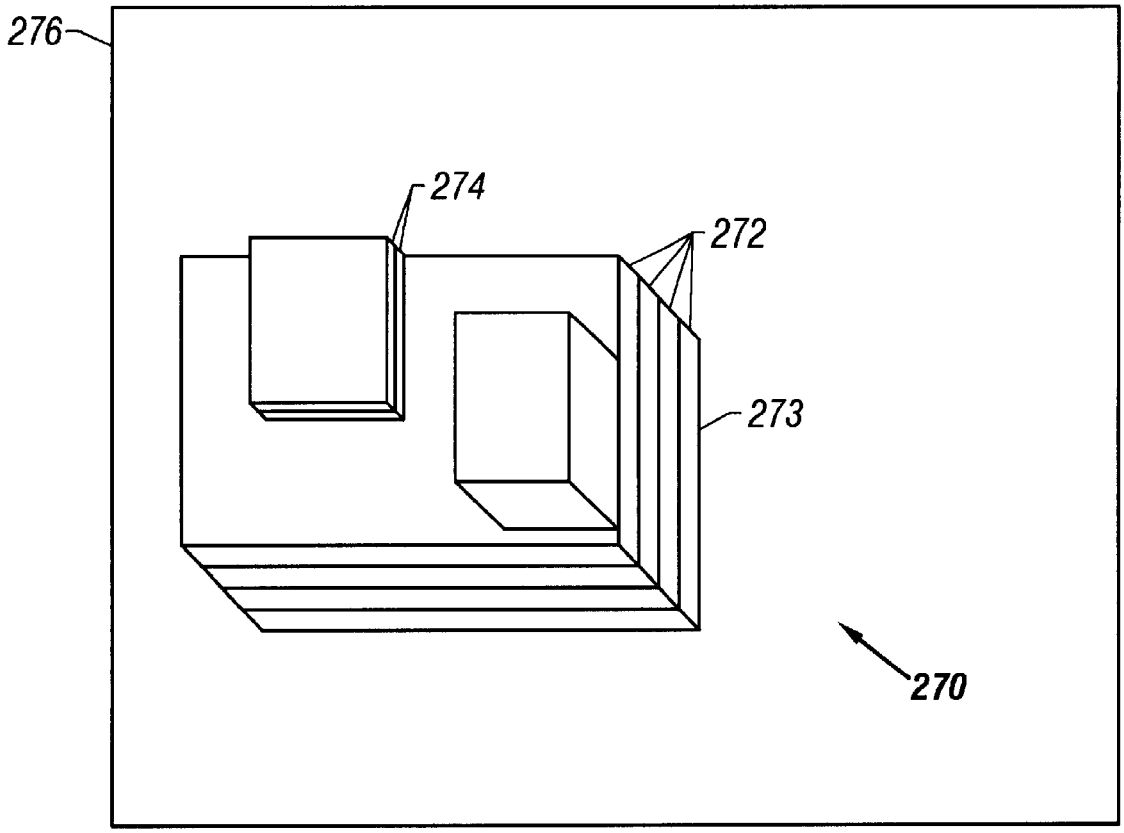
FIG. 13 illustrates a macro-structure formed by electromagnetic powder deposition.

FIG. 13 illustrates a macro-structure 270 produced by electromagnetic particle deposition. The macro-structure has multiple layers 272, 273, 274 resulting from several passes of electromagnetic powder deposition with the railgun 92 illustrated in FIGS. 2–4. The lowest layer 273 of the macro-structure 270 is fusion bonded to the substrate 276, and the layers 272, 273, 274 are fusion bonded to each other by melting of the powder particles and/or comparable masses of the substrate 276 upon impact. In some embodiments, the layers 272, 273, 274 have thicknesses between about 0.0001 inches and 0.005 inches. The particles used to form the layers can be composed of a variety of materials, e.g., metals, polymers, ceramics, dielectrics or refractories. The macro-structure 270 may have a microscopic structure substantially similar to the material from which the powder particles are formed, because the flowing together of melted particles and/or substrate forms fewer voids, i.e., lower porosity, in the mass, than thermal spray techniques. Subsequent machining of the layers 272, 273, 274 after completion of the electromagnetic deposition process may produce a non-trivial 3-dimensional shape for the macro-structure 270. The size, shape, and composition of the macro-structure 270 are application specific and not essential to the practice of the present invention.

Figure 14A:
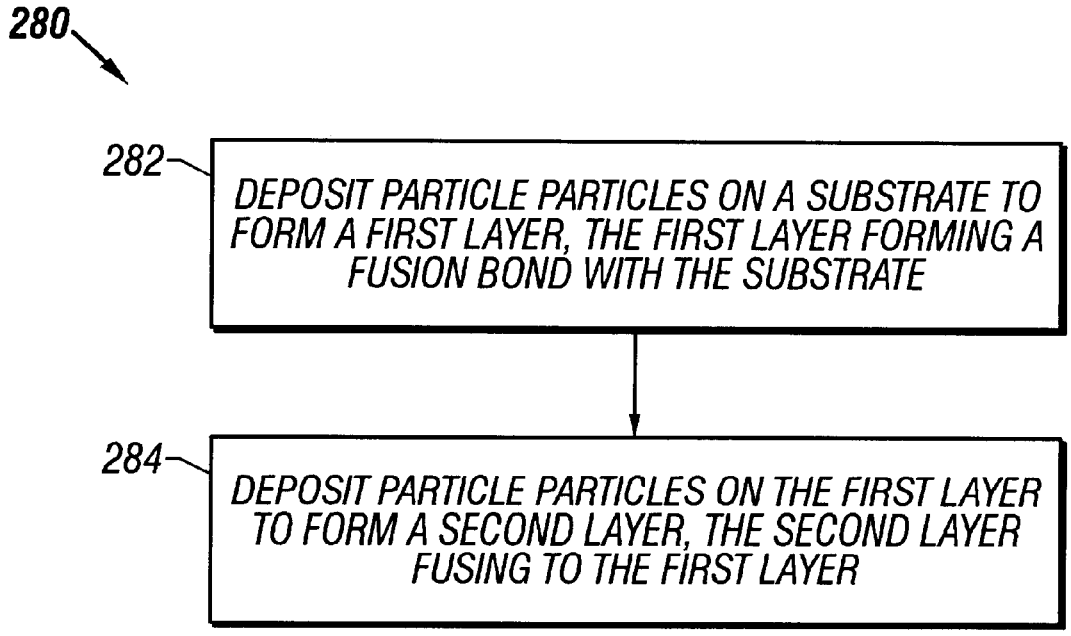
FIG. 14A is a flowchart of an embodiment of a method for producing a macrostructure by electromagnetic powder deposition.

FIG. 14A is a flowchart illustrating a method 280 for producing the macro-structure 270 of FIG. 13. At block 282, the first layer 273 of powder particles is deposited on the surface of the substrate 276, e.g., using the railgun 92 illustrated in FIGS. 2–4. The powder particles melt upon impact so that a fusion bond forms between the first layer 273 and the substrate 276. At block 284, a second layer 272 of powder particles is deposited on the first layer 273. The second layer 272 fuses to the first layer 273 due to melting of the powder particles upon impact.

Figure 14B:
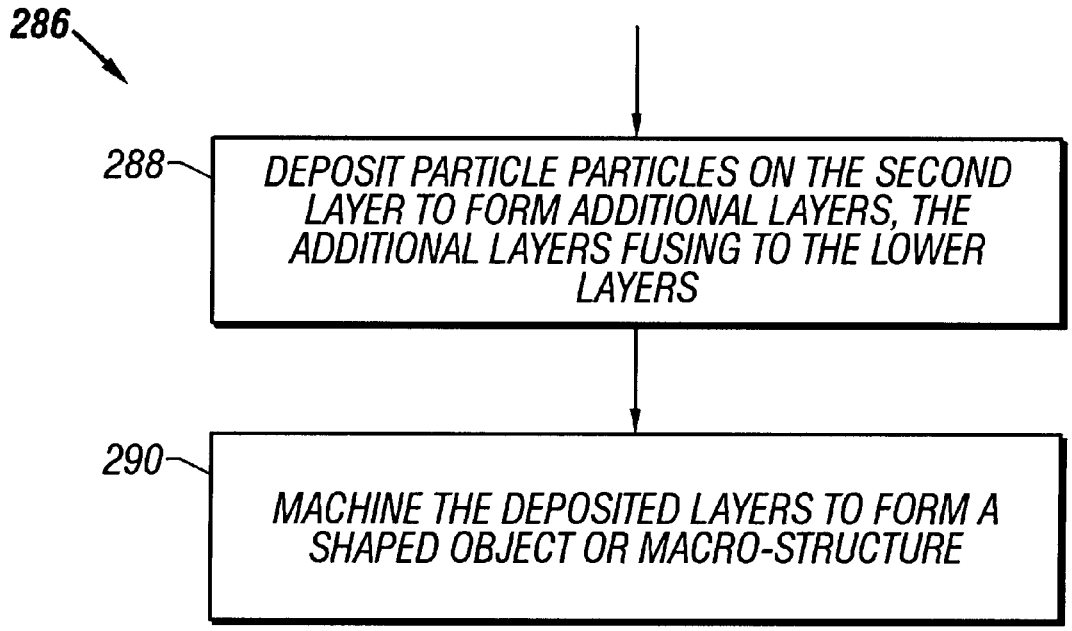
FIG. 14B is a flowchart illustrating the additional steps of some embodiments for methods for producing a macrostructure by electromagnetic powder deposition.

FIG. 14B is a flowchart illustrating additional steps of some methods 286 for producing the macro-structure 270 of FIG. 13. At block 288, additional layers 272, 274 are deposited on the second layer 272 produced at block 284 of FIG. 14A. The additional layers 272, 274 form fusion bonds to each other and to the second layer 272 due to melting of powder particles upon impact with the underlying layers 272, 273, 274. In some embodiments, the joints between layers disappear due to the melting and fusion bonding. The various layers 272, 273, 274 may have different thicknesses and may be formed with powder particles of different materials. At block 290, the deposited layers 272, 273, 274 are machined to give the final macro-structure 270 a selected 3-dimensional shape. The substrate 270 and the underlying layers 272, 273, 274 may also be masked during deposition steps to produce the 3-dimensional shape. The final macro-structure 270 may have a variety of shapes and, in some embodiments thicknesses are from about 0.0002 inches to greater than one inch. The shape and size of the final macro-structure 270 are determined by application specific considerations, which are not essential to the present invention.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method for depositing powder particles on a substrate, comprising:

forming a plasma armature;

accelerating the plasma armature;

accelerating a column of gas with the plasma armature; and accelerating the powder particles with the column of gas toward a substrate;

whereby the powder particles are deposited on the substrate.

2. The method as set forth in claim 1, wherein the step of accelerating the column of gas further comprises compressing the column of gas by a factor of between three and six.

3. The method as set forth in claim 2, wherein the step of compressing includes compressing ambient gas, the ambient gas being at atmospheric pressure.

4. The method as set forth in claim 1, wherein the step of accelerating the plasma armature includes accelerating the plasma armature to supersonic velocities.

5. The method as set forth in claim 1, wherein the step of forming a plasma armature includes making a plasma arc in an ambient gas at substantially atmospheric pressure.

6. The method as set forth in claim 1, wherein the step of accelerating the plasma armature includes accelerating the plasma armature along a portion of the bore of a railgun.

7. The method as set forth in claim 6, wherein the step of accelerating powder particles includes forming a cloud of powder particles in the bore of the railgun.

8. The method as set forth in claim 6, wherein the step of accelerating the powder particles includes accelerating the particles to a kinetic energy great enough to cause the powder particles to melt upon impact with the substrate.

9. The method as set forth in claim 6, wherein the step of accelerating the plasma armature includes producing a current pulse in the rails of the railgun, the magnetic field associated with the current pulse accelerating the plasma armature.

10. The method as set forth in claim 9, further comprising terminating the current pulse, the step of accelerating the powder particles being performed after terminating the current pulse.

11. The method as set forth in claim 9, wherein the step of forming a plasma armature includes ionizing a region of ambient gas substantially simultaneously with the step of forming a current pulse.

12. The method as set forth in claim 9, wherein the step of ionizing a region of ambient gas includes applying a voltage signal having frequency of between 5 and 200 Mega-Hertz to an electrode in a cavity connected to the interior of the railgun.

13. The method as set forth in claim 1, wherein the step of accelerating the powder particles includes accelerating particles having a diameter of 10 to 200 microns.

14. The method as set forth in claim 1, wherein the step of accelerating the powder particles includes accelerating the powder particles with a column of inert gas.

15. A method for depositing powder particles on a substrate, comprising:

accelerating a column of gas towards the substrate using magnetic fields;

accelerating the powder particles with the column of gas; and forming a fusion bond between a portion of the powder particles and the substrate in response to impact with the substrate.

16. The method as set forth in claim 15, wherein the act of forming includes melting a portion of the powder particles in response to impact of the portion of the powder particles with the substrate.

17. The method as set forth in claim 16, wherein the act of forming includes melting a portion of the substrate in response to the impact of the one of the powder particles with the substrate, the melted portion of the substrate being at least as great as half of the mass of one of the powder particles.

18. The method as set forth in claim 15, wherein the act of accelerating a column includes compressing the column of gas to at least three times the density of ambient gas.

19. The method as set forth in claim 16, wherein the act of accelerating the powder particles gives the portion of the powder particles supersonic velocities.

20. A method for producing a macro-structure on a substrate, comprising:

accelerating powder particles toward the substrate using magnetic forces;

forming a first layer by depositing the powder particles on the substrate, the powder particles forming a fusion bond with the substrate; and forming a second layer by depositing powder particles on the first layer, the powder particles of the second layer forming a fusion bond with the first layer.

21. The method as set forth in claim 20, further comprising forming additional layers by depositing powder particles on the second layer, the powder particles of the additional layers forming fusion bonds with the underlying layers.

22. The method as set forth in claim 21, further comprising machining the deposited layers to form an object with a 3-dimensional shape.

23. The method as set forth in claim 21, wherein at least two of the acts of forming use particles of different compositions.

24. The method as set forth in claim 21, wherein the acts of forming produce layers having at least two different thicknesses.

* * * * *